United States Patent [19]

Camp et al.

[11] Patent Number: 4,806,155

[45] Date of Patent: Feb. 21, 1989

[54] METHOD FOR PRODUCING DYSPROSIUM-IRON-BORON ALLOY POWDER

[75] Inventors: Floyd E. Camp, Trafford, Pa.; Stanley A. Wooden, Sonora, Ky.

[73] Assignee: Crucible Materials Corporation, Pittsburgh, Pa.

[21] Appl. No.: 73,727

[22] Filed: Jul. 15, 1987

[51] Int. Cl.[4] ..... B22F 9/22; B22F 9/24

[52] U.S. Cl. ..... 75/0.5 AA

[58] Field of Search ..... 75/0.5 AA; 420/83, 121

[56] References Cited

U.S. PATENT DOCUMENTS

| | | | |
|---|---|---|---|
| 4,020,236 | 4/1977 | Aonuma et al. | 75/0.5 AA |
| 4,375,372 | 3/1983 | Koon et al. | 420/83 |
| 4,578,242 | 3/1983 | Sharma | 420/83 |
| 4,612,068 | 9/1986 | Tanaka et al. | 420/83 |
| 4,663,066 | 5/1987 | Fruchart et al. | 420/83 |
| 4,664,724 | 5/1987 | Mizoguchi et al. | 420/83 |

FOREIGN PATENT DOCUMENTS

| | | | |
|---|---|---|---|
| 197712 | 10/1986 | European Pat. Off. | 420/83 |
| 61-000534 | 1/1986 | Japan | 420/83 |

*Primary Examiner*—Wayland Stallard

*Attorney, Agent, or Firm*—Finnegan, Henderson, Farabow, Garrett & Dunner

[57] ABSTRACT

A method for producing a dysprosium-iron alloy for use in the manufacture of rare-earth element containing, iron-boron permanent magnets. A particle mixture of dysprosium oxide, iron, boron and calcium is compacted, the compact is heated to form a metallic compound comprising dysprosium, boron and iron and to form calcium oxide. There is no need for additives such as calcium chloride that aid in particle disintegration during washing.

A particle mass of −35 mesh is produced from the compact. The particle mass is washed with cold water, and the water is reacted with the calcium oxide and calcium to form calcium hydroxide, while preventing oxidation of the particle mass. The calcium hydroxide is removed from the particle mass as by repeated water washing.

20 Claims, No Drawings

METHOD FOR PRODUCING DYSPROSIUM-IRON-BORON ALLOY POWDER

BACKGROUND OF THE INVENTION

1. Field of the Invention

This invention relates to a method for producing a rare-earth element containing iron or iron and boron alloy, and particulary a dysprosium-iron-boron alloy, adapted for use in the manufacture of rare-earth element containing, iron-boron permanent magnets.

2. Description of the Prior Art

It is known to produce permanent magnet alloys of a light rare-earth element, such as neodymium, in combination with iron and boron. It has been determined that light rare-earth element containing magnets of this composition may be improved from the standpoint of increasing coercivity by incorporating therein the heavy rare-earth element, dysprosium. The amounts of dysprosium used for this purpose vary within the range of 0.5 to 8% by weight, depending upon the coercivity required.

Dysprosium is conventionally added to light rare-earth element containing iron-boron magnets by introducing dysprosium in elemental form prior to alloy melting.

To obtain dysprosium of a purity suitable for introducing to an alloy melt, high-cost refining practices are required, which add significantly to the overall cost of producing the alloy. Dysprosium oxide, however, is significantly less expensive than the pure element dysprosium.

It is known to alloy dysprosium with iron by a reduction-diffusion process embodying calcium as the reductant. The amount of metallic calcium used may vary from 1.2 to 3.5 times (weight ratio) the amount stoichiometrically necessary to reduce the oxygen in the dysprosium oxide. The alloy may also contain additional elements such as boron and other rare earth elements in minor amounts with iron and dysprosium being the major constituents of the alloy. It is also known to include calcium chloride ($CaCl_2$) as an ingredient in the reduction-diffusion process for the purpose of aiding in particle disintegration during calcium oxide removal steps.

Thereafter, the alloy in particle form is mixed with a light rare earth element containing, iron-boron alloy in the desired proportions to achieve the final alloy composition. The powder mixture is processed conventionally to produce permanent magnets which includes cold pressing, sintering, and heat treatment.

In the reduction-diffusion process, calcium oxide (CaO) results as a by-product from the calcium reduction of the dysprosium oxide ($Dy_2O_3$). Prior to further processing and use of the dysprosium-iron-boron alloy, it is necessary to remove the calcium oxide, as well as any excess, unreacted calcium.

This is achieved by washing with water which reacts with the calcium and calcium oxide to produce calcium hydroxide ($Ca(OH)_2$). These reactions are exothermic:

$$Ca+2H_2O \rightarrow Ca(OH)_2+H_2+\text{heat (99.2 Kcal/mole)}$$

$$CaO+H_2O \rightarrow Ca(OH)_2+\text{heat (15.6 Kcal/mole)}.$$

Consequently, the particle size of the comminuted reaction mass must be maintained rather large (8 mesh U.S. Standard) so that the surface area available for reaction is small and heat is generated at a slow and manageable rate. Smaller particle sizes and larger reaction areas result in sudden exothermic heating causing water temperatures to approach the boiling point. This is undesirable since the reduced rare earth metals may readily be re-oxidized.

The calcium chloride interspersed within the 8 mesh particles is more soluble in water than the other constituents. This allows the particles to slowly decrepitate as the calcium chloride is dissolved. It also creates new calcium and calcium oxide reaction surfaces at a rate where their heat generation is manageable. An undesirable aspect of including calcium chloride is that compounds such as dysprosium chloride ($DyCl_3$) or iron chloride ($FeCl_3$) may be formed during the reduction-diffusion step. Such compounds are also very water soluble and are thereby lost with the wash water. This adds to the overall cost of the process by reducing the amount of usable alloy recovered.

The particle size of the final washed material should be on the order of 35 mesh or finer so that it may expeditiously be further comminuted to 2 to 3 micron powder for the purpose of magnet manufacturing.

SUMMARY OF THE INVENTION

It is accordingly an object of the present invention to provide a method for producing a dysprosium-iron-boron alloy in particle form adapted for use in the manufacture of rare-earth element containing, iron-boron permanent magnets, wherein powder particles of the desired fine particle size may be used during the calcium and calcium oxide removal step incident to reduction-diffusion, while avoiding oxidation of the powder particles by high wash water temperatures.

It is accordingly another object of this invention to eliminate the use of additives such as calcium chloride for the purpose of particle disintegration during the calcium and calcium oxide removal step, and thereby form no extraneous, water soluble, dysprosium or iron chlorides during the reduction-diffusion step which may then be lost through water washing.

In accordance with the invention, a rare earth element oxide powder such as dysprosium oxide powder is mixed with iron and calcium or iron, boron and calcium and cold compacted to achieve a consolidated article of a density sufficient for handling. This article is heated in a protective atmosphere for time and temperature sufficient to alloy the dysprosium with iron and produce calcium oxide. Unreacted calcium is also present in the article. The article is cooled to ambient temperature and comminuted, as by crushing or milling, to produce a particle mass; this operation is performed in a protective atmosphere, such as argon. Upon comminution of the article to the required particle size, which may be −35 mesh, the particles are washed with cold water at a temperature no greater than 10° C. This operation is generally repeated until substantially all of the calcium oxide and calcium are exothermally converted to calcium hydroxide. By the use of water of this maximum temperature, effective conversion to calcium hydroxide and removal of the calcium oxide is achieved while preventing oxidation of the fine alloy particles. Because the required, fine particle size may be used in accordance with the practice of the invention while avoiding oxidation, the use of calcium chloride to facilitate subsequent particle size reduction operations in accordance with prior art practices is not required.

The starting alloy, in accordance with the invention, may contain, in addition to iron, dysprosium oxide and calcium, additional rare-earth oxides and boron which may be alloyed with iron. Although heating times may vary depending upon temperature and the mass of the consolidated article, the article is heated for a time and temperature to form a metallic compound comprising dysprosium and iron and to form incident thereto calcium oxide. Suitable times at temperature are 1000° to 1200° C. for 3 to 10 hours.

To prevent oxidation during washing of the particle mass upon completion of reduction-diffusion and comminution of the article, a water temperature no greater than 10° C. and preferably within the range of 1° to 10° C. is desired.

DETAILED DESCRIPTION OF THE PREFERRED EMBODIMENTS

Reference will now be made in detail to presently preferred embodiments of the invention, examples of which are described below. In the examples and through the specification and the claims, all parts and percentages are by weight unless otherwise indicated.

EXAMPLE 1

The following amounts of raw materials were weighed and mixed together on a roller mill:

930 g $Dy_2O_3$
103 g $HRE_2O_3$ (Other heavy rare-earth oxides)
986 g Fe Powder 70% −325 mesh
114 g FeB −100 mesh 17.5% B
400 g Ca 98% Atomized 0.2 to 2 mm particle size The mixture was placed in a rubber bag and cold isostatically pressed at 40,000 psi to form a briquette, which was placed into a covered, carbon steel boat. The reduction-diffusion was carried out in a tube furnace, which was first evacuated then backfilled with argon gas. The furnace temperature was raised from 800° C. to 1100° C. over a two-hour period, held there for 10 hours, then cooled to almost ambient temperature while still in the furnace.

The cooled compact was then jaw crushed and disc pulverized to a fine, −35 mesh powder while under a protective blanket of argon. The powder was added to 2 liters of ice water for the first of 9 or 10 agitated water washes to physically remove calcium in the form of $Ca(OH)_2$ slurry. Both the reaction byproduct, CaO, and the 30% excess calcium metal are quickly and exothermically converted to $Ca(OH)_2$ upon contact with water. This heat generation requires using ice water for the initial washing. Without cooling in this manner, the water temperature can approach boiling.

The majority of the $Ca(OH)_2$ was removed by the water washings. Residual amounts required a chemical treatment. This was done by adding acetic acid to bring the pH from +11 down to 7 or 8. Several water rinses were then made followed with alcohol rinses to facilitate drying of the powder.

During this treatment dysprosium losses were slight, as indicated by comparing the calculated and analyzed compositions of this material:

| | Calculated | Analyzed |
|---|---|---|
| Dy | 40.5 | 38.4 |
| HRE | 4.5 | 2.4 |
| Fe | 54.0 | 56.1 |
| B | 1.0 | 1.09 |

-continued

| | Calculated | Analyzed |
|---|---|---|
| Ca | 0 | .43 |
| $O_2$ | 0 | .35 |

(HRE — heavy rare-earth elements)

EXAMPLE 2

The following amounts of raw materials were weighed and mixed on a roller mill:

930 g. $Dy_2O_3$
103 g. $HRE_2O_3$
114 g. FeB −100 mesh 17.5% B
400 g. Ca 99.6%, Atomized to 0.2 to 2 mm particle size These are identical weights of material to Example 1. A higher purity calcium metal (99.6%) was the only difference. The subsequent processing was identical with Example 1 and gave the following results:

| | Calculated | Analyzed |
|---|---|---|
| Dy | 40.5 | 39.0 |
| HRE | 4.5 | 2.36 |
| Fe | 54.0 | 56.3 |
| B | 1.0 | 1.05 |
| Ca | 0 | .05 |
| $O_2$ | 0 | .11 |

EXAMPLE 3

The following amounts of raw materials were weighed and mixed as in the previous examples:

930 g. $Dy_2O_3$
103 g. $HRE_2O_3$
986 g. Fe Powder 70% −325 mesh
114 g. FeB −100 mesh 17.5% B
400 g. Ca 98% −6 mesh chunks The only difference between this and the previous two examples is the calcium metal. A larger particle size (−6 mesh) of 98% calcium was used. The processing of this batch was identical to the previous two, with the following results:

| | Calculated | Analyzed |
|---|---|---|
| Dy | 40.5 | 39.2 |
| HRE | 4.5 | 2.3 |
| Fe | 54.0 | 55.3 |
| B | 1.0 | 1.06 |
| Ca | 0 | .5 |
| $O_2$ | 0 | .72 |

EXAMPLE 4

The following amounts of raw materials were weighed and mixed:

439 g. $Dy_2)_3$
78 g. $HRE_2)_3$
493 g. Fe Powder 70% −325 mesh
57 g. FeB −100 mesh
200 g. Ca 99.6% Atomized 0.2 to 2 mm particle size In this example, the batch size was reduced and a less pure dysprosium oxide (85% $Dy_2O_3$) was used. The subsequent processing was the same except that smaller water volumes (1.5 liters) were used in the washing iterations. The results were as follows:

| | Calculated | Analyzed |
|---|---|---|
| Dy | 38.3 | 37.2 |
| HRE | 6.7 | 4.6 |
| Fe | 54.0 | 56.9 |
| B | 1.0 | 1.04 |
| Ca | 0 | .69 |
| $O_2$ | 0 | .57 |

The material produced in Example 1 was jet milled to a 2.0 micron particle size then mixed, in various proportions, to a jet milled NdFeB alloy containing no dysprosium. Normal magnet making techniques were followed to produce magnets with the following intrinsic coercivities:

| % Dy Analyzed in Magnet | Intrinsic Coercivity, Hci, Oe |
|---|---|
| 0 | 11,200 |
| 1.6 | 14,500 |
| 2.2 | 16,400 |
| 3.2 | 17,100 |
| 4.8 | 21,800 |

The materials of Examples 2, 3, and 4 have likewise produced similar results. In particular, Example 4 material has been incorporated into a magnet that exhibited an intrinsic coercivity of 24,500 Oe at a 4.8% Dy level.

It may be seen from these experimental results that the invention provides an effective and low cost practice for incorporating dysprosium into light rare-earth element, iron-boron permanent magnet alloys.

What is claimed is:

1. A method for producinq a dysprosium-iron alloy adapted for use in the manufacture of rare-earth element containing, iron-boron permanent magnets, said method including providing a particle mixture comprising dysprosium oxide, iron and calcium, compacting said particle mixture to produce a consolidated article, heating said article for a time at temperature to form a metallic compound comprising dysprosium and iron and to form calcium oxide, producing a particle mass of −35 mesh from said compact, washing said particle mass with water at a temperature no greater than 10° C. to react said calcium and said calcium oxide therewith to form ca-lcium hydroxide, while preventing oxidation of said particle mass, and removing said calcium hydroxide from said particle mass.

2. The method of claim 1 wherein said consolidated article is heated at 1000° to 1200° C. for 3 to 10 hours to form said metallic compound.

3. The method of claim 1 wherein said article is cooled to ambient temperature prior to producing said particle mass therefrom.

4. The method of claim 1 wherein said water is at a temperature within the range of 1° to 10° C.

5. A method for producing a dysprosium-iron alloy adapted for use in the manufacture of rare-earth element containing, iron-boron permanent magnets, said method including providing a particle mixture comprising dysprosium oxide, iron and calcium, said calcium being within the particle size range of 6 mesh to 80 mesh, compacting said particle mixture to produce a consolidated article, heating said article at 1000° to 1200° C. for 3 to 10 hours to form a metallic compound comprising dysprosium and iron and to form calcium oxide, producing a particle mass of −35 mesh from said compact, washing said particle mass with water at a temperature no greater than 10° C. to react said calcium and said calcium oxide therewith to form calcium hydroxide, while preventing oxidation of said particle mass, and removing said calcium hydroxide from said particle mass.

6. A method for producing a dysprosium-iron alloy adapted for use in the manufacture of rare-earth element containing iron-boron permanent magnets, said method including providing a particle mixture comprising dysprosium oxide iron and calcium and excluding calcium chloride and calcium hydride, compacting said particle mixture to produce a consolidated article, heating said article for a time at temperature to form a metallic compound comprising dysprosium and iron and to form calcium oxide, producing a particle mass of −35 mesh from said compact, washing said particle mass with water at a temperature no greater than 10° C. to react said calcium and said calcium oxide therewith to form calcium hydroxide, while preventing oxidation of said particle mass and removing said calcium hydroxide from said particle mass.

7. The method of claim 6 wherein said consolidated article is heated at 1000° to 1200° C. for 3 to 10 hours to form said metallic compound.

8. The method of claim 6 wherein said article is cooled to ambient temperature prior to producing said particle mass therefrom.

9. The method of claim 6 wherein said water is at a temperature within the range of 1° to 10° C.

10. A method of producing a dysprosium-iron alloy adapted for use in the manufacture of rare-earth element containing, iron-boron permanent magnets, said method including providing a particle mixture comprising dysprosium oxide, iron and calcium, and excluding calcium chloride and calcium hydride, said calcium being within the particle size range of 6 mesh to 80 mesh, compacting said particle mixture to produce a consolidated article, heating said article at 1000° to 1200° C. for 3 to 10 hours to form a metallic compound comprising dysprosium and iron and to form calcium oxide, producing a particle mass of −35 mesh from said compact, washing said particle mass with water at a temperature no greater than 10° C. to react said calcium and said calcium oxide therewith to form calcium hydroxide, while preventing oxidation of said particle mass, and removing said calcium hydroxide from said particle mass.

11. A method for producing a dysprosium-iron alloy adapted for use in the manufacture of rare-earth element containing, iron-boron permanent magnets, said method including providing a particle mixture comprising dysprosium oxide, iron, boron and calcium, compacting said particle mixture to produce a consolidated article, heating said article for a time at temperature to form a metallic compound comprising dysprosium, boron and iron and to form calcium oxide, producing a particle mass of −35 mesh from said compact, washing said particle mass with water at a temperature no greater than 10° C. to react said calcium and said calcium and said calcium oxide therewith to form calcium hydroxide, while preventing oxidation of said particle mass, and removing said calcium hydroxide from said particle mass.

12. The method of claim 11 wherein said consolidated article is heated at 1000° to 1200° C. for 3 to 10 hours to form said metallic compound.

13. The method of claim 11 wherein said article is cooled to ambient temperature prior to producing said particle mass therefrom.

14. The method of claim 11 wherein said water is at a temperature within the range of 1° to 10° C.

15. The method of claim 11 wherein calcium chloride is excluded from said particle mixture.

16. A method for producing a rare-earth element containing iron alloy adapted for use in the manufacture of rare-earth element containing, iron-boron permanent magnets, said method including providing a particle mixture comprising a rare-earth element oxide, iron and calcium, compacting said particle mixture to produce a consolidated article, heating said article for a time at temperature to form a metallic compound comprising a rare-earth element and iron and to form calcium oxide, producing a particle mass of −35 mesh from said compact, washing said particle mass with water at a temperature no greater than 10° C. to react said calcium and said calcium oxide therewith to form calcium hydroxide, while preventing oxidation of said particle mass, and removing said calcium hydroxide from said particle mass.

17. The method of claim 16 wherein said consolidated article is heated at 1000° to 1200° C. for 3 to 10 hours to form said metallic compound.

18. The method of claim 16 wherein said article is cooled to ambient temperature prior to producing said particle mass therefrom.

19. The method of claim 16 wherein said water is at a temperature within the range of 1° to 10° C.

20. The method of claim 16 wherein calcium chloride is excluded from said particle mixture.

* * * * *

UNITED STATES PATENT AND TRADEMARK OFFICE

CERTIFICATE OF CORRECTION

PATENT NO. : 4,806,155

DATED : February 21, 1989

INVENTOR(S) : Floyd E. Camp and Stanley A. Wooden

It is certified that error appears in the above-identified patent and that said Letters Patent is hereby corrected as shown below:

IN THE SPECIFICATION:

Col. 4, line 13, after "$HRE_2O_3$" insert as a new line --986g. Fe Powder 70% - 325 mesh--.

IN THE CLAIMS:

Claim 1, col. 5, line 45, change "ca-licium" to --calcium--.

Signed and Sealed this

Twenty-eighth Day of August, 1990

*Attest:*

*Attesting Officer*

HARRY F. MANBECK, JR.

*Commissioner of Patents and Trademarks*